United States Patent [19]

Suzuki et al.

[11] Patent Number: 4,986,229

[45] Date of Patent: Jan. 22, 1991

[54] APPARATUS FOR SUPPLYING START FUEL FOR A CARBURETOR

[75] Inventors: Shin Suzuki, Natori; Shuichi Sasaki, Shibata; Masao Suzuki, Igu, all of Japan

[73] Assignee: Walbro Far East, Inc., Kawasaki, Japan

[21] Appl. No.: 434,298

[22] Filed: Nov. 13, 1989

[30] Foreign Application Priority Data

Nov. 26, 1988 [JP] Japan ..... 63-299026

[51] Int. Cl.[5] ..... F02M 1/08

[52] U.S. Cl. ..... 123/179 G; 123/180 E

[58] Field of Search ..... 123/179 G, 179 L, 180 E, 123/438

[56] References Cited

U.S. PATENT DOCUMENTS

| | | | |
|---|---|---|---|
| 1,837,298 | 12/1931 | Starr | 123/180 E |
| 3,693,603 | 9/1972 | Lemanczyk | 123/179 G |
| 4,480,618 | 11/1984 | Kamifuji et al. | 123/179 G |
| 4,862,847 | 9/1989 | Kobayashi et al. | 123/180 E |

*Primary Examiner*—Andrew M. Dolinar

*Attorney, Agent, or Firm*—Barnes, Kisselle, Raisch, Choate, Whittemore & Hulbert

[57] ABSTRACT

An apparatus for supplying start fuel for a carburetor in which an internal combustion engine has a fly-wheel with a magneto incorporated therewith. An intake air passage has an electromagnetic valve and this valve is actuated by an output signal of a primary coil of the fly-wheel magneto. In one embodiment, the electromagnetic valve is actuated by an output difference between an output signal of a primary coil produced when a start motor is rotated and an output signal of the primary coil produced when the engine is rotated.

6 Claims, 3 Drawing Sheets

APPARATUS FOR SUPPLYING START FUEL FOR A CARBURETOR

FIELD OF THE INVENTION

The present invention relates to an apparatus for supplying start fuel for a carburetor in which the start fuel is automatically supplied in connection with the starting conditions of the engine.

BACKGROUND AND FEATURES OF THE INVENTION

A start electric motor is mounted even on a small internal combustion engine such as a portable working machine to facilitate a starting operation. The present applicants have previously filed a Japanese patent application, Ser. No. 166473/1988, which discloses an apparatus wherein an ambient temperature is detected by a temperature switch in order to supply a rich mixture to the engine at the time of cold start, and when the ambient temperature is low, an electric fuel pump is driven to supply start fuel to an air intake passage of a carburetor. However, it is preferable that the addition of the electric fuel pump and the temperature switch be avoided, since these increase the cost and the apparatus becomes larger in size with a weight increase.

In view of the aforementioned problems, an object of the present invention is to provide an apparatus for supplying start fuel for a carburetor which is low in cost and small and light weight wherein start fuel is automatically supplied to a carburetor in correspondence to the starting conditions of the engine without using a temperature switch.

For achieving the aforesaid object, the present invention provides an arrangement, in an internal combustion engine, which is provided with a fly-wheel magneto for supplying start fuel from a fuel chamber of a carburetor to an air intake passage via an electromagnetic valve. The electromagnetic valve is actuated by an output signal of a primary coil of the fly-wheel magneto.

DETAILED DESCRIPTION OF THE INVENTION

A. Brief Description of the Operation

Figure 1:
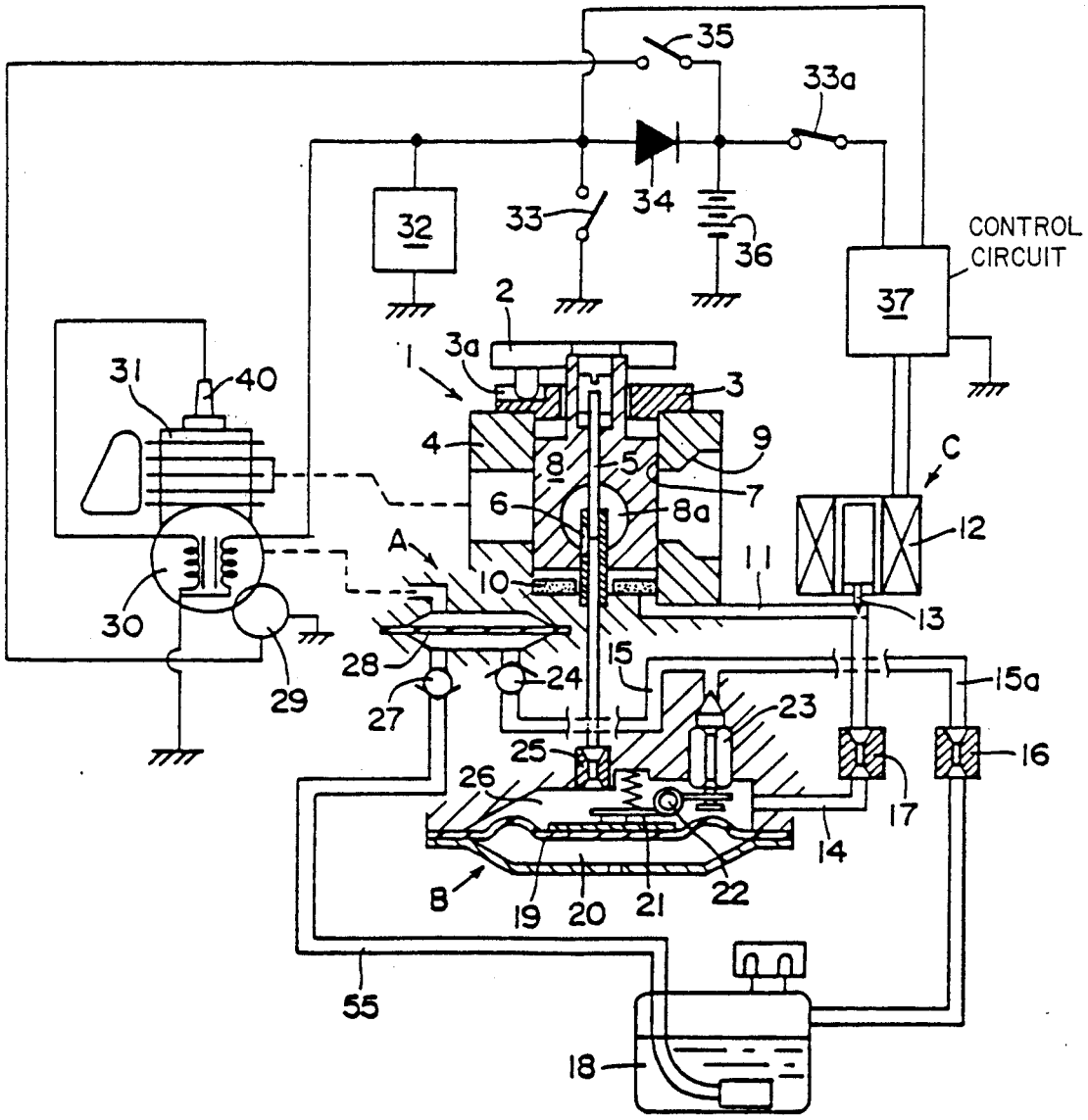
FIG. 1 is a sectional side view showing a schematic structure of an apparatus for supplying start fuel for a carburetor according to the present invention.

In case the engine 31 is restarted when an ambient temperature is high or immediately after the engine 31 stopped, the engine 31 is started simultaneously with cranking of the engine 31 caused by an electric starter motor 29 (or simultaneously with recoiling operation), and the rotational frequency of the engine well exceeds the rotational frequency of the start electric motor 29 (or the rotational frequency of the engine caused by the recoiling operation). Immediately after the idling state of the engine 31 is detected by current, voltage or pulse number of a primary coil of a fly-wheel magneto 30, an electromagnetic valve C is closed so that a supply of start fuel from a fuel pump A to a fuel reservoir 10 via a fuel chamber 26 and the electromagnetic valve C is cut off. Therefore, the smooth idling rotation of the engine 31 is maintained.

In case the ambient temperature is so low that the engine 31 is not yet warmed up, the rotational frequency of the engine is equal to that of the start electric motor 29 immediately after the engine is started, and the start fuel is supplied from the fuel pump A to the fuel reservoir 10 of the carburetor 1 via the fuel chamber 26 and the electromagnetic valve C and finally drawn into an air intake passage 9 from the fuel reservoir 10. When a rich mixture is fed to the engine 31, the engine 31 is started. When the rotational frequency of the engine exceeds that of the start electric motor 29, the electromagnetic valve C is closed to discontinue a supply of start fuel from the fuel pump A to the fuel reservoir 10.

However, some start fuel remains in the fuel reservoir 10, and therefore, the rich mixture is continuously fed to the engine 31 for a while, and the warming-up operation of the engine 31 is smoothly achieved.

B. Detailed Description of Invention and the Various Elements Thereof

FIG. 1 is a schematic structural view of an apparatus for supplying start fuel according to the present invention in case of a diaphragm type carburetor. The apparatus for supplying start fuel has a body 4 comprising a diaphragm type fuel pump A, a fuel supply mechanism B, an electromagnetic valve C for opening and closing a passage between the fuel supply mechanism B and a fuel reservoir 10, and a control circuit 37 for controlling the operation of the electromagnetic valve C according to a signal for a primary coil 30*a* (FIG. 2) of a fly-wheel magneto 30 of the engine 31.

In the carburetor 1, a rotary type throttle valve 8 is rotatably and axially movably supported on a cylindrical portion 7 crossing an air intake passage 9 of the body 4. A throttle valve 8 having a throttle bore 8*a* has a lever 2 coupled to a small diameter shaft portion at the upper end thereof, and a follower suspended from the lever 2 is biased and engaged by means of a spring, not shown, with a cam 3*a* formed on a lid 3 which closes the cylindrical portion 7. When the throttle valve 8 is rotated by the lever 2 to increase its opening degree, a needle valve 5 coupled to the throttle valve 8 moves upward to increase the opening degree of a fuel nozzle 6, increase a quantity of fuel and increase an output of the engine 31.

A fuel reservoir 10 for retaining the start fuel is formed at a bottom of the cylindrical portion 7, namely, at the lower side of the throttle valve 8 so that when the engine 31 is started, fuel in the fuel reservoir 10 is drawn into the air intake passage 9 from a clearance between the cylindrical portion 7 and the throttle valve 8. The fuel reservoir 10 contains therein a porous member, preferably, such as ceramics.

The fuel pump A comprises a pulsating pressure introducing chamber and a pump chamber which are defined by a diaphragm 28 within the carburetor body 4, the pulsating pressure introducing chamber being communicated to a crank chamber of the engine 31. The pump chamber is communicated to a fuel tank 18 via a check valve 27 and a pipe 55, and also communicated to a fuel chamber called a metering chamber 26 of the fuel supply mechanism B via a check valve 24, a pipe 15 and an inlet valve 23. A pipe 15*a* branched from the pipe 15 is communicated to the fuel tank 18 via an orifice 16.

The fuel supply mechanism B comprises a metering chamber 26 and an atmospheric chamber 20 which are defined by a diaphragm 19 within the carburetor body 4. A lever 21 is supported by a supporting shaft 22 in the metering chamber 26. The lever 21 has one end urged by means of a spring against the diaphragm 19 and the other end urged so as to engage and close an inlet valve 23. The metering chamber 26 is communicated with the fuel nozzle 6 of a fuel supply pipe via a fuel jet 25. The metering chamber 26 is further communicated with the aforesaid fuel reservoir 10 via a passage 14, an orifice 17, a valve chamber of the electromagnetic valve C and a passage 11.

Figure 2:
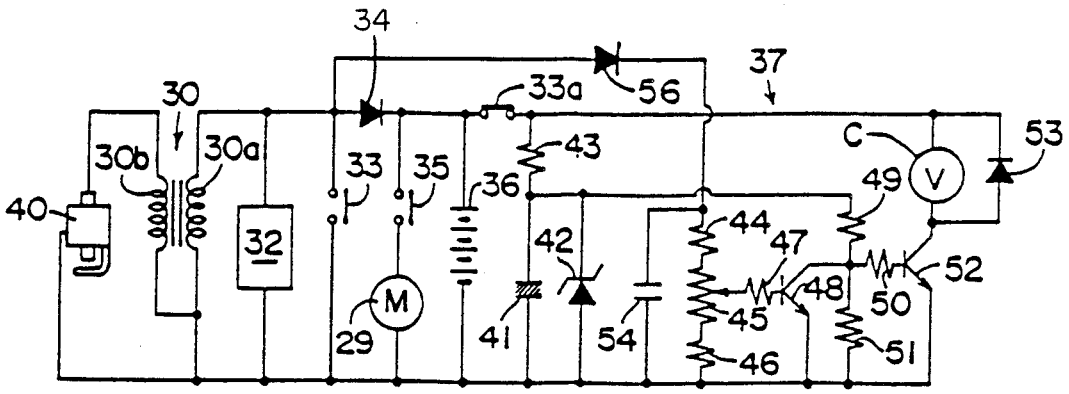
FIG. 2 is a electric circuit of the apparatus for supplying start fuel.

FIG. 2 shows a control circuit for controlling the operation of the electromagnetic valve C. As shown at the left half portion in FIG. 2, a spark circuit unit 32, in which a spark plug 40 is driven by a fly-wheel magneto 30, is connected to a power source battery 36 through a diode 34. A series circuit comprising a start switch 35 and an electric starter motor 29 is connected to the power source battery 36. Reference numeral 33 designates a stop switch for shortcircuiting between both terminals of the spark plug 40 to stop the engine 31.

As shown at the right half portion in FIG. 2, a control circuit 37 is formed. Reference numeral 33*a* designates a switch operatively connected with the stop switch 33, resistors 43–47 and 49–51, a Zener diode 42, capacitors 41 and 54, transistors 48 and 52, and diodes 53 and 56.

OPERATION OF THE APPARATUS

In the following, the operation of the apparatus for supplying start fuel will be described. When the start switch 35 is closed, the electric starter motor 29 is rotated, and the fly-wheel is rotated together with the crank shaft of the engine 31, whereby an induction current flows into the primary coil 30*a*, and high voltage is applied between both terminals of the spark plug 40 in synchronism with rotation of the engine 31. The induction voltage of the primary coil 30*a* increases proportional to the rotational frequency of the engine.

Figure 3:
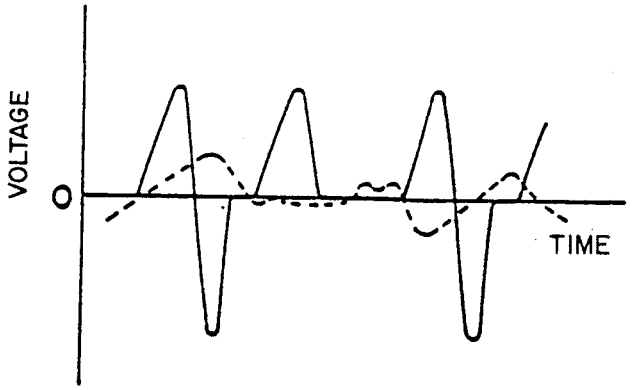
FIG. 3 is a characteristic diagram between the rotational frequency of a primary coil of a fly-wheel magneto and the voltage.

The induction voltage of the primary coil 30*a* is very low as indicated by the broken line in FIG. 3 in the state where the engine 31 is driven by the start electric motor 29, and the induction voltage is high as indicated by the solid line when the engine 31 is started into idling rotation.

In FIG. 2, in the case where the voltage of the primary coil 30*a* is low, the current from the power source battery 36 to the base of the transistor 48 via the resistors 44, 45 and 47 is very low, and the transistor 48 is in a non-energized state. At that time, a large current flows from the power source battery 36 to the base of the transistor 52 via the switch 33*a*, resistors 43, 49 and 50, and the transistor 52 is energized and an electromagnetic coil of the electromagnetic valve C is energized to open the latter. The current flowing into the resistor 51 is set to be fine.

When the engine 31 is started into idling rotation, the voltage of the primary coil 30*a* increases and the current flowing into the base of the transistor 48 increases so that the transistor 48 is energized. With this, the current flows from the power source battery 36 to the negative pole of the power source battery 36 via the switch 33*a*, the resistors 43 and 49 and the transistor 48. The current flowing into the base of the transistor 52 via the resistor 50 greatly decreases, the transistor 52 is deenergized. The electromagnetic coil of the electromagnetic valve C is deenergized to close the latter.

As described above, the electromagnetic valve C is closed when the engine 31 reaches the idling rotation. Therefore, the start fuel for producing a rich mixture according to the operating conditions of the engine 31 such as ambient temperature is supplied to smoothly start the engine 31.

Figure 4:
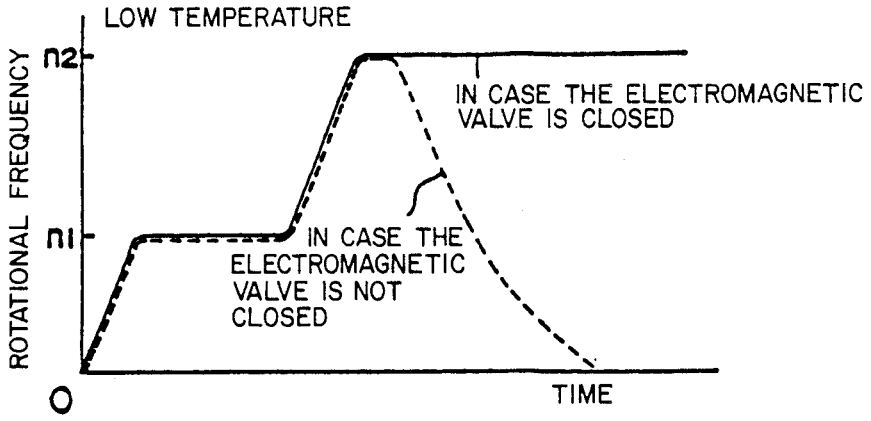
FIGS. 4 and 5 are respectively start characteristic diagrams of the engine.

As indicated by the solid line in FIG. 4, in the case where the ambient temperature is low, when the start electric motor 29 is rotated (rotational frequency - n1), the diaphragm 28 of the fuel pump A (FIG. 1) is reciprocated upward and downward by the pulsating pressure of the crank chamber of the engine 31, and the fuel in the fuel tank 18 is drawn into the pump chamber of the fuel pump A via the pipe 55 and the check valve 27 and thence supplied to the metering chamber 26 via the check valve 24, the pipe 15 and inlet valve 23. The fuel in the metering chamber 26 is supplied from the fuel nozzle 6 to the throttle bore 8*a* through the fuel jet 25. At the same time, the fuel in the metering chamber 26 is fed to the fuel reservoir 10 via the passage 14, the electromagnetic valve C and the passage 11. When the fuel in the fuel reservoir 10 is drawn into the air intake passage 9 to feed the rich mixture to the engine 31, the engine 31 is started. When the engine 31 reaches the idling rotation (rotational frequency - n2), the electromagnetic valve C is closed, and the fuel in the metering chamber 26 is not supplied to the fuel reservoir 10. However, since the start fuel remaining in the porous member of the fuel reservoir 10 is continuously fed to the air intake passage 9 for a while, the smooth warm-up operation of the engine 31 is maintained.

If the electromagnetic valve C is not closed even if the engine 31 reaches the idling rotation, the fuel in the metering chamber 26 is continuously supplied to the fuel reservoir 10, and therefore, the rich mixture is still supplied to the engine 31. In this case the engine 31 becomes disorderly and stops before long, as indicated by the dotted line (FIG. 4).

In FIG. 4, it takes a little time for the engine 31 to reach the idling rotation because fuel is not well vaporized since the temperature of the engine and the open air is low.

On the other hand, in the case where the ambient temperature of the engine 31 is high or in the case where even at the low temperature, the engine is restarted after stopped, when the start electric motor 29 is rotated, the engine 31 is momentarily started to reach the idling rotation. Meanwhile, the fuel in the metering chamber 26 is supplied to the fuel reservoir 10 via the electromagnetic valve C, but the electromagnetic valve C is closed immediately after the engine 31 reaches the idling rotation. Therefore, the idling rotation of the engine 31 is smoothly maintained as indicated by the solid line in FIG. 5.

Figure 5:
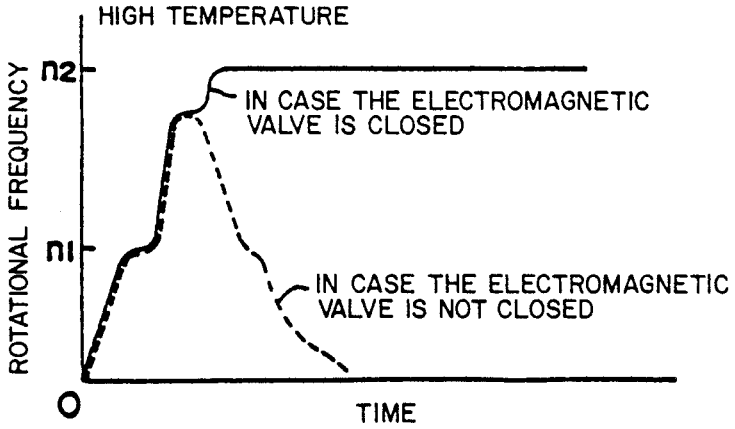

If the electromagnetic valve C remains opened, even if the engine 31 reaches the idling rotation as indicated by the broken line in FIG. 5, the rich mixture is continuously supplied to the engine 31, and, therefore, the engine 31 becomes disorderly and stops before long.

While in the above-described embodiment, the electromagnetic valve is controlled according to the variation in voltage of the primary coil of the fly-wheel magneto, it is to be noted that the electromagnetic valve can be controlled by the current flowing into the primary coil or the pulse number, in place of the voltage.

As described above, according to the present invention, in an internal combustion engine provided with a fly-wheel magneto for supplying start fuel from a fuel chamber of a carburetor to an air intake passage via an electromagnetic valve, the electromagnetic valve is actuated, by an output signal of a primary coil of the fly-wheel magneto. Therefore, when the engine is rotated by the start electric motor or recoiling operation, the fuel in the fuel chamber is supplied to the fuel reservoir via the electromagnetic valve, the start fuel is supplied from the fuel chamber to the air intake passage, and the rich mixture is supplied to the engine. However, since the electromagnetic valve is closed immediately after the engine has been started, the supply of the start fuel from the fuel chamber to the fuel reservoir is discontinued whereby the smooth rotation of the engine is maintained. Particularly, in the start at high temperature, the engine is started immediately after cranking caused by the start electric motor, and therefore, the start fuel, by which the smooth idling rotation of the endings is impaired, is rarely supplied.

For the most part, the engine is cranked by the start electric motor but this cranking can be done by the pull rope commonly used when a start motor is not a part o the assembly. The hand pull rope is used with a spring recoil mechanism and this hand cranking is sometimes referred to as a recoiling operation. Thus, the engine can be cranked by either the start electric motor or the hand pulled recoil operation As compared with the conventional system in which the ambient temperature is detected by the temperature switch, and when the ambient temperature is low, the electric fuel pump is driven, the apparatus of the present invention requires neither temperature switch nor start fuel pump. The electromagnetic valve is closed in response to a variation in voltage, current or pulse number of the primary coil of the fly-wheel magneto. Therefore, the cost is reduced, the start fuel is supplied according to the conditions required for the start fuel, and the smooth start of the engine can be attained.

Since the temperature switch is not provided, cumbersome work such as selecting and mounting a variety of temperature switches according to the particulars of the engine as encountered in the prior art is eliminated.

According to the present invention, as an apparatus for supplying start fuel for a carburetor, all the constituent members are disposed to be concentrated on the peripheral portions of the carburetor, thus avoiding a larger type of apparatus.

We claim:

1. An apparatus for supplying start fuel for a carburetor, wherein an internal combustion engine provided with a fly-wheel magneto for supplying start fuel from a fuel chamber of a carburetor to an air intake passage via an electromagnetic valve characterized in the said electromagnetic valve is actuated by an output signal of a primary coil of said fly-wheel magneto.

2. The apparatus for supplying start fuel for a carburetor according to claim 1, wherein said electromagnetic valve is actuated by an output difference between an output signal of a primary coil produced when the engine is cranked and an output signal of a primary coil produced when the engine is rotated in an idling mode.

3. The apparatus for supplying start fuel for a carburetor according to claim 1, wherein when the engine is cranked, said electromagnetic valve is opened, and when the engine is rotated in an idling mode, said electromagnetic valve is closed.

4. The apparatus for supplying start fuel for a carburetor according to claim 1, wherein the output signal of the primary coil of said fly-wheel magneto is a voltage produced in the primary coil.

5. The apparatus for supplying start fuel for a carburetor according to claim 1, wherein the output signal of the primary coil of said fly-wheel magneto is a current produced in the primary coil.

6. The apparatus for supplying start fuel for a carburetor according to claim 1, wherein the output signal of the primary coil of said fly-wheel magneto is the pulse number produced in the primary coil.

* * * * *